United States Patent [19]

Lockard et al.

[11] Patent Number: 4,981,305

[45] **Date of Patent: * Jan. 1, 1991**

[54] SYMMETRICALLY MODULAR WHEELCHAIR

[75] Inventors: Walter G. Lockard; Allen J. Boris, both of Elyria; Wieslaw Kosc, North Royalton, all of Ohio

[73] Assignee: Invacare Corporation, Elyria, Ohio

[ * ] Notice: The portion of the term of this patent subsequent to Jun. 20, 2006 has been disclaimed.

[21] Appl. No.: 365,535

[22] Filed: Jun. 13, 1989

Related U.S. Application Data

[63] Continuation of Ser. No. 913,501, Sep. 30, 1986, Pat. No. 4,840,390.

[51] Int. Cl.[5] ..... A61G 5/02

[52] U.S. Cl. ..... 280/250.1; 280/42; 280/304.1; 297/433; 297/DIG. 4

[58] Field of Search ..... 280/304.1, 250.1, 42, 280/202; 297/DIG. 4, 433, 417, 429; 16/29, 38, 42 T

[56] References Cited

U.S. PATENT DOCUMENTS

| | | | |
|---|---|---|---|
| 1,393,842 | 10/1921 | Slater | 16/29 |
| 1,514,720 | 11/1924 | Pauly | 280/202 |
| 2,354,949 | 8/1944 | Ducavich | 155/140 |
| 2,914,111 | 11/1959 | Mize | 155/28 |
| 3,453,027 | 7/1969 | Pivacek | 297/429 |
| 3,854,774 | 12/1974 | Limpach | 297/433 |
| 3,883,175 | 5/1975 | Rodaway | 297/417 |
| 4,358,125 | 11/1982 | Charles | 280/242 |
| 4,486,048 | 12/1984 | Meyer | 297/433 |
| 4,500,109 | 2/1985 | Volin | 280/650 |
| 4,676,519 | 6/1987 | Meier | 280/250.1 |
| 4,813,693 | 3/1989 | Lockard et al. | 280/304.1 |
| 4,840,390 | 6/1989 | Lockard et al. | 280/304.1 |

FOREIGN PATENT DOCUMENTS

| | | |
|---|---|---|
| 593384 | 10/1947 | United Kingdom . |
| 672174 | 5/1952 | United Kingdom . |

OTHER PUBLICATIONS

Rolls 500 ATS, Brochure from Invacare, Inc., 1985.

*Primary Examiner*—David M. Mitchell

*Attorney, Agent, or Firm*—Fay, Sharpe, Beall, Fagan, Minnich & McKee

[57] ABSTRACT

A pair of identical side frames (A) are each made up of a pair of generally L-shaped tubular members which are welded together. A reinforcing tube (30) is slidably received within a forward portion (14) of each side frame to strengthen an interconnection with a front wheel assembly mounting bracket (32) with mechanical fasteners. A swing away leg rest mounting bracket (50) is also connected with the forward tubular portion and reinforcing tube for selectively supporting a swing away leg rest assembly thereon. A folding mechanism (D) includes a pair of pivotally connected seat support structures (100). The seat support structures include seat side supports (102) which have a longer free end (106) and shorter free end (108), cross members 104 and fittings (120). Circumferentially disposed grooves (124) are offset in such a manner that the seat support structures are interchangeable. An arm rest assembly (F) is releasably connected with the side frames with brackets (162, 174) such that the arm support structure can be selectively removed from the brackets or pivoted about one of them.

12 Claims, 8 Drawing Sheets

SYMMETRICALLY MODULAR WHEELCHAIR

BACKGROUND OF THE INVENTION

This is a continuation of application Ser. No. 913,501 filed Sept. 30, 1986 now U.S. Pat. No. 4,840,390.

The present invention relates to vehicles, particularly vehicles for use by the mobility impaired. The invention finds particular application in conjunction with light weight, foldable wheelchairs which are readily transported to a site of use. Such chairs are frequently used by the elderly and others who have limited mobility, but lack the endurance for shopping centers and other activities. Although described in conjunction with light weight wheelchairs, it will be appreciated that the invention will find utility with other wheelchairs and vehicles.

Heretofore, wheelchairs have had a large number of left handed and right handed parts. That is, parts designed for the left side of the wheelchair could not be interchanged with parts from the right side of the wheelchair or vice versa. This lack of interchangeability increased manufacturing complexity and inventory. Moreover, separate inventories were necessary for aftermarket replacement parts for the left and right hand sides of the wheelchairs.

Most non-prescription wheelchairs have a very limited number of options. Rather, non-prescription chairs have numerous weld joints which permanently affix the various components and subassemblies. Such chairs are not readily amenable to varying the features. Instead, such chairs are normally designed to fall in different price ranges, each range having preselected features.

The present invention provides a wheelchair that has numerous modules and components that can be readily added or deleted and which may be utilized on either side of the chair.

SUMMARY OF THE INVENTION

In accordance with one aspect of the present invention, a wheelchair is provided in which the left and right side frames are identical and interchangeable. Each side frame includes first and second bent, generally L-shaped tubing sections. Front and rear wheel assemblies are mounted to the respective side frames.

In accordance with another aspect of the present invention, the side frames each have a generally vertical forward tubular portion in which a reinforcing tube is slidably received. Front wheel assemblies are attached to the forward tubular side frame portions by mechanical fasteners which extend through front wheel assembly mounting brackets, the forward tubular portion, and the reinforcing tube to mount the wheel assemblies to the side frames.

In accordance with another aspect of the present invention, mechanical fasteners are utilized to interconnect a pair of front leg rest mounting members to forward tubular side frame portions in which reinforcing tubes are slidably received.

In accordance with another aspect of the present invention, a wheelchair is provided that has selectively removable, swing-away arm rest assemblies. Each arm rest assembly includes first and second mounting brackets connected to the wheelchair side frames. An arm support portion is releasably supported by the first and second mounting brackets. Releasing the arm support portion from both the first and the second brackets enables the arm support portion to be removed. The first mounting bracket is pivotally connected to the side frame such that by releasing the side arm from the second mounting bracket only, the side arm assembly may be pivoted.

In accordance with another aspect of the present invention, a cross brace folding mechanism is provided for folding the wheelchair side frames together. The cross brace includes a pair of cross brace members which are each connected at an upper end with the seat and at a lower end with a horizontal portion of the side frame. Each cross brace member has a fitting on the lower end that defines a side frame receiving passage such that the fitting rotates on the horizontal side frame portion. A circumferentially extending groove and a mating projection maintain accurate positioning between the fitting and the horizontal side frame.

In accordance with another aspect of the present invention, a foldable wheelchair is provided in which the folding mechanism includes a pair of identical seat support structures which are interchangeable. Each structure includes a seat side support which is fixedly interconnected with a cross brace member. The upper end of each cross brace member is connected offset from the center of the seat side support such that the side support has a longer free end and a shorter free end. The cross brace members are pivotally interconnected such that one of the seat side supports is disposed with the side support longer free end forward and the other is mounted with the shorter free end forward. The relative lengths of the longer and shorter free ends are selected relative to the diameter of the cross brace members and relative to the size of the pivotal interconnection such that the front ends of the longer and shorter side support free ends are even.

In accordance with a more limited aspect of the invention, fittings mounted to the lower end of the cross brace members, wrap around a horizontal portion of the side frame. Pivotal links extend from the cross brace members and are pivotally connected to an upper portion of the side frame. The fittings and the pivotal links are held in alignment with circumferential groove and projection arrangements, which arrangements are disposed in the same position on both the left and right side frames and symmetrically on the seat support assemblies such that the seat support structures are reversable.

One advantage of the present invention is that it reduces replacement part and manufacturing inventories.

Another advantage of the present invention is that it facilitates customizing non-prescription wheelchairs and the selective addition of features and options.

Another advantage of the present invention is that it improves the manufacturing economy. Many features are included in this chair which heretofore have been available only on more expensive chairs.

Further advantages of the present invention reside in its modular construction and use of modules and components which are mountable on either the left or right hand side of the chair.

Still further advantages of the present invention will become apparent to those of ordinary skill in the art upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment and are not to be construed as limiting the invention.

DETAILED DESCRIPTION OF THE PREFERRED EMBODIMENTS

Figure 1:
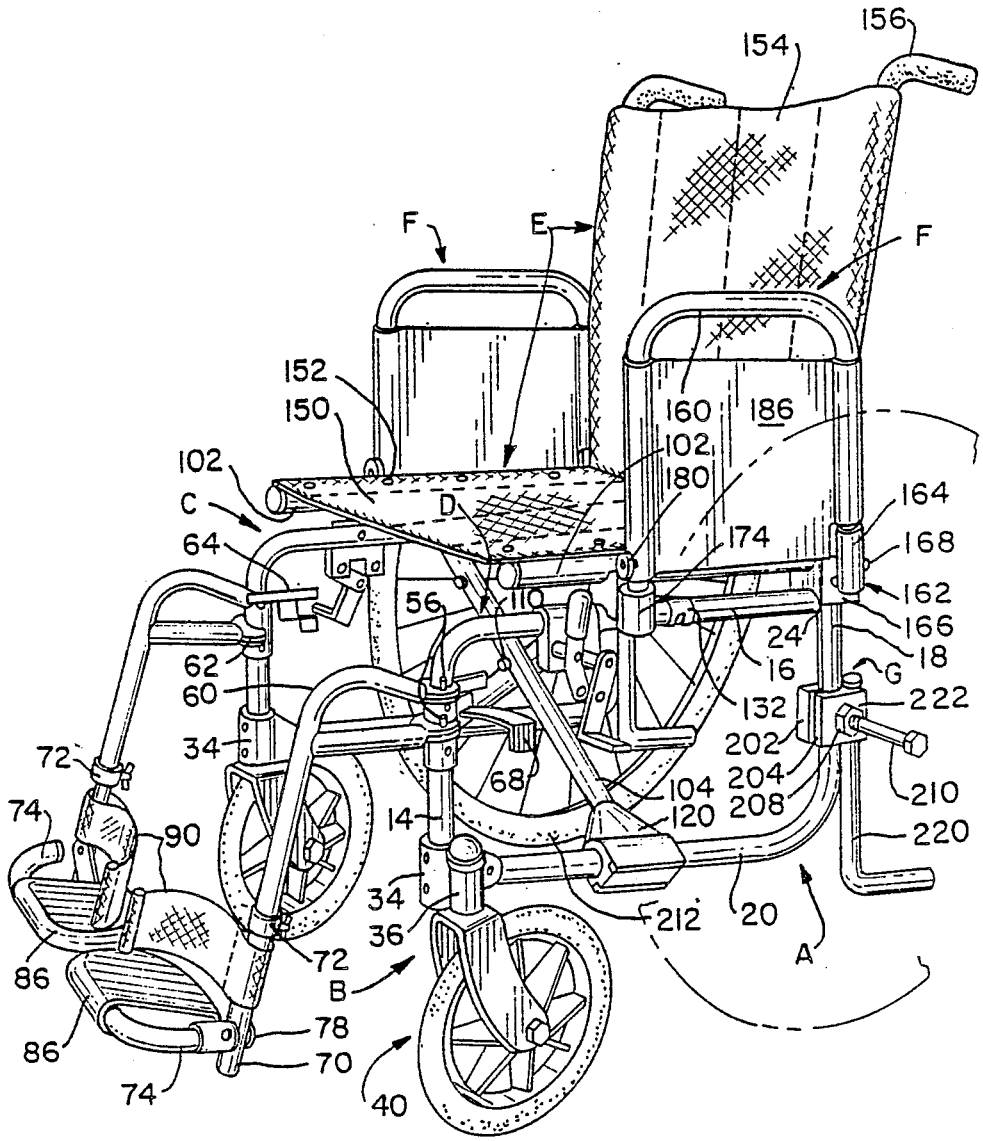
FIG. 1 is a perspective view of a wheelchair in accordance with the present invention with the near side rear wheel in phantom.

With reference to FIG. 1, the wheelchair includes a pair of identical side frames A. Front wheel assemblies B and leg support assemblies C are connected to a forward portion of the side frames. A folding mechanism D selectively enables the side frames to be moved together for more compact storage and easier handling. A seat E supports the operator. Selectively removable arm rest assemblies F are pivotally connected to the side frames to enable the arm support to be either pivoted relative to the frame or completely removed. A rear wheel and curb step mounting assembly G selectively mounts rear wheels to the side frame and reinforces their interconnection.

Figure 2:
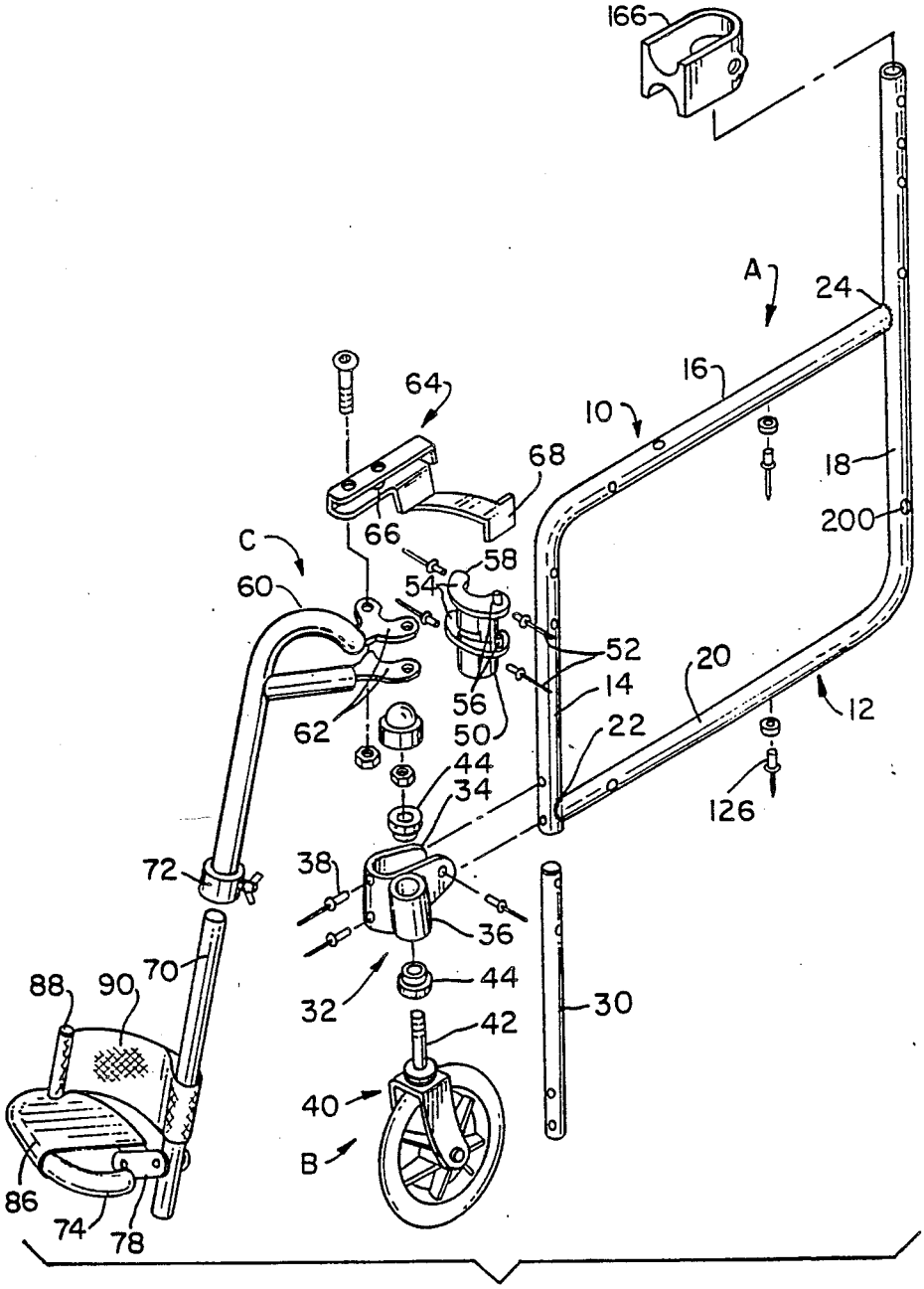
FIG. 2 is an exploded view illustrating a wheelchair side frame and the mounting arrangement for a front leg rest and front wheel assembly.

With particular reference to FIG. 2, the side frames A are each constructed of relatively thin walled, light weight tubing, such as aluminum, magnesium, titanium, and their alloys. Thin walled steel tubing is also contemplated. Because the left and right side frames are identical, to simplify inventory demands, only one of the side frames will be described in detail and it is to be appreciated that the description applies equally to both. The side frame consists of only a first generally L-shaped tubing section 10 and a second generally L-shaped tubing section 12. The first L-shaped tubing section includes a first or forward generally vertically disposed tubular portion or forward leg 14 which is intergrally connected by a bend with a first or upper generally horizontally disposed tubular portion or leg 16. The second L-shaped tubing section includes a second or rearward generally vertically disposed tubular portion or leg 18 and a second or lower generally horizontally disposed tubular portion or leg 20. The L-shaped tubing sections are welded at a forward lower interconnection 22 and a rearward upper interconnection 24. The forward, lower weld junction is reinforced by the front wheel mounting assembly B and the rearward upper weld joint is reinforced by the arm support assemblies F. This reinforcing of the welds with other assemblies facilitates the use of lighter weight tubing without sacrificing the reliability and durability of tubing junctions. In the preferred embodiment, the second, rearward vertical tubular portion extends upward beyond the upper rearward weld 24 to mount a portion of the seat E thereon. Optionally, a separate tubing portion may be interconnected to the side frame by a hinge or the like to support the upper seat portion.

The front wheel assemblies B are each connected with a corresponding one of the side frames A. A reinforcing tube 30 is slidably received in the front, vertical side frame tubing portion 14 to provide greater structural strength. A front wheel mounting bracket 32 is mounted to the side frame adjacent the forward, lower weld 22 to mount front wheel casters and to reinforce the weld. More specifically, the front wheel assembly mount includes a generally U-shaped bracket 34 to which a tubular portion 36 is welded. The bracket 34 and the tubular portion 36 are configured and interconnected to be symmetric about a horizontal axis such that the mount can be rotated top for bottom and used on the opposite side of the chair. Mechanical fasteners 38 extend through corresponding bores in the U-shaped bracket 34, the side frame forward, vertical tubular frame portion 14 and the lower horizontal frame portion 20, and the reinforcing tube 30. The mechanical fasteners may be bolts, pop-rivets or the like. A front wheel caster 40 has an upstanding post 42 which is mounted by appropriate bearings and other mounting means 44 to the front wheel mounting assembly bracket tube 36. Due to the symmetry of the mount, the stud 42 and the bearings and other mounting structures 44 may be inserted into the tubular portion 36 from either direction to enable the same parts to be used as either a right or left front wheel assembly.

With continuing reference to FIG. 2, the front leg support assembly C includes a mounting bracket 50 which is interconnected by mechanical fasteners 52 with corresponding apertures in the front generally vertical tubular frame portion 14 and the reinforcing tube 30. Each leg rest mounting bracket includes a pair of cams 54 which have pivot pins 56 at one end and locking surfaces 58 at their other ends. Optionally, the pivot pins 56 may extend symmetrically through the cam surfaces to enable the bracket 50 to be inverted top to bottom for placement on the opposite side of the frame.

An upper leg support mounting member 60 has a pair of hinge plates 62 that have apertures for receiving the pins 56 of the mounting bracket 50. A spring biased cam follower assembly 64 is pivotally mounted to one of the hinge plates such that a spring biases a follower portion 66 thereof against the corresponding one of cams 54. The cam follower portion 66 is spring biased to lock behind the locking surfaces 58 when the leg support member is facing straightforward. By pressing a manual, release lever 68, the cam follower 66 is biased against the spring out of contact with the stop surfaces 58 to allow the leg assembly to pivot on pivot pins 56. The hinge members 62 may be asymmetric to limit their mounting to the left or right side of the chair to prevent the leg rest assemblies from being mounted backwards. Optionally, the hinge members may be symmetric about a central axis and define pivot holes on either side thereof. The symmetric positioning of holes for the cam follower enables the leg rest to be mounted on either side of the chair.

Figure 3:
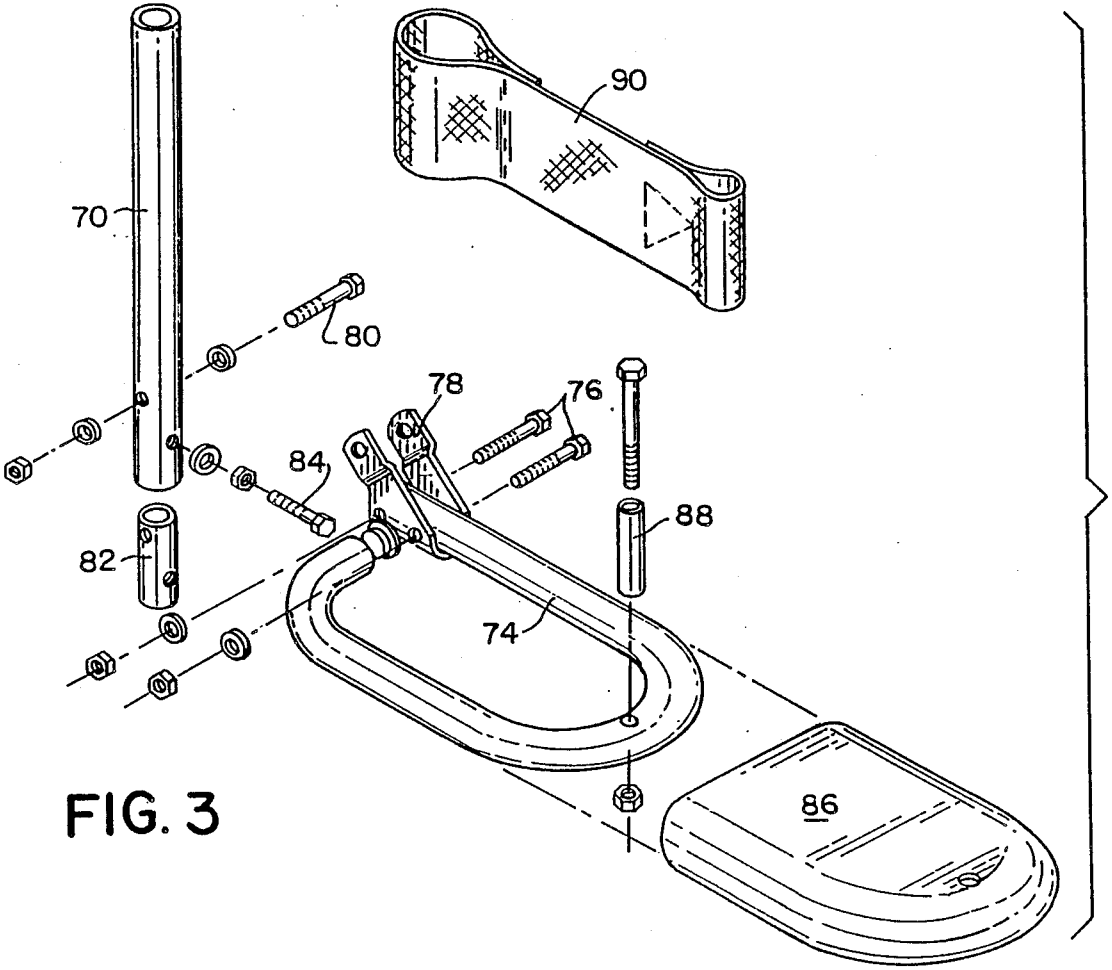
FIG. 3 is an exploded view illustrating the front foot support assembly.

With continuing reference to FIG. 2 and further reference to FIG. 3, a foot support extension tube 70 is telescopically received in portion 60 with a degree of telescopic receipt set by a clamping means 72. A generally U-shaped foot rest member 74 is connected by mechanical fasteners 76 to a mounting bracket 78. The generally U-shaped member 74 and the mounting bracket 78 are the same for both left and right side foot rests, but their interconnection is reversed by 180°. Another mechanical fastener 80 pivotally interconnects the bracket 78 with the extension tube 70. A solid plug 82 provides increased structural strength to the lower end of tube 70. An adjustable stop, such as a bolt 84 is tapped into the plug 82 and abuts the bracket 78. By adjusting the distance with which the stop 84 extends from the plug 82, the rest position of the foot rest is selectively adjustable.

A molded plastic foot rest cover 86 slides over the U-shaped tube 74 and is anchored thereto by a post 88. A foot support strap 90 is telescopically received over the extension tube 70 and the post 88. The post 88 is mounted symmetrically in the U-shaped portion 74 such that the foot rest cover 86 may be utilized with either the left or right side.

Figure 4:
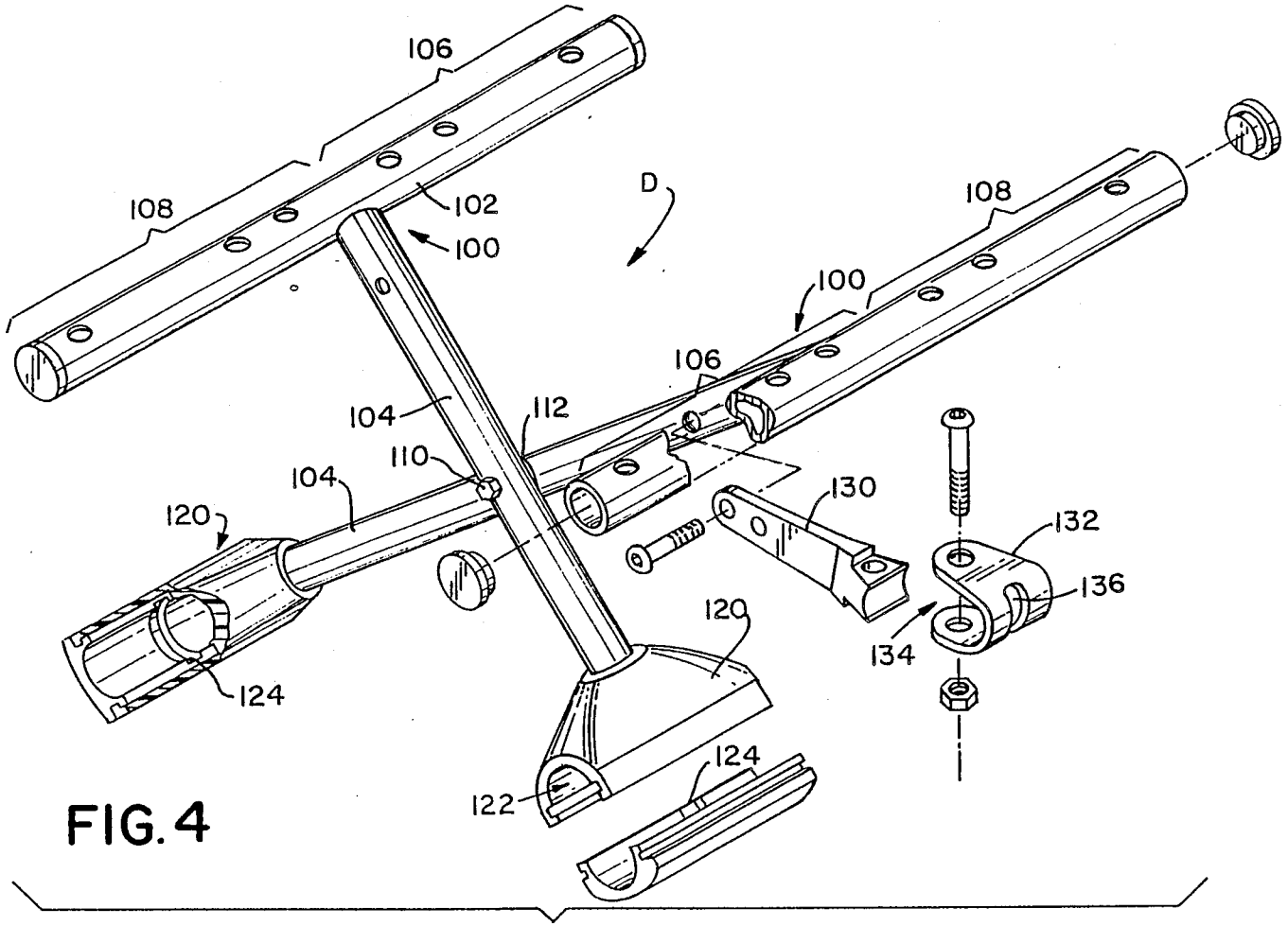
FIG. 4 is a perspective view illustrating the folding mechanism of the wheelchair.
Figures 5, 6:
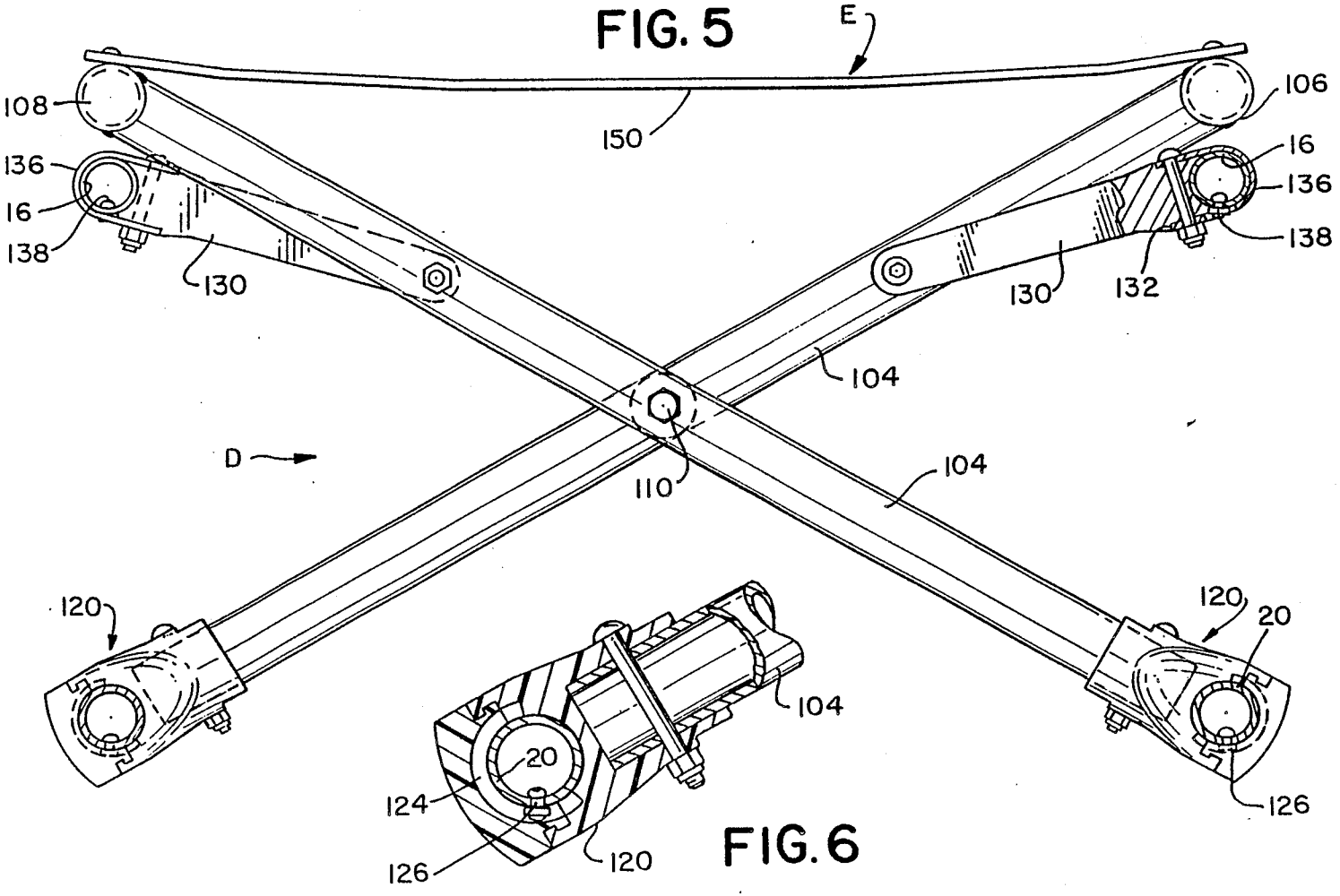
FIG. 5 is a front view of the folding mechanism.
FIG. 6 is a sectional view through one of the fittings at the lower end of the folding mechanism.

With continuing reference to FIG. 1 and further to FIGS. 4 and 5, the folding mechanism D is interconnected with the side frames A and the seat E. The folding mechanism includes two identical generally T-shaped seat support structures 100. Each seat support structure includes a seat support member 102 which is connected with a cross brace member 104. The cross brace member is interconnected with the seat support member 104 offset from its center such that the seat side support member 102 defines a longer free end 106 and a shorter free end 108. The cross brace members are interconnected by a pivot joint 110 which may include a nylon spacer or the like 112 between the cross members. The relative lengths of the longer and shorter free ends are selected relative to the diameter of the cross brace members and the thickness of any washer 112 such that the forward most ends of the seat support member are parallel and the rearward most ends of the seat support members are parallel.

A fitting 120 is interconnected with the lower end of each cross member for rotatable interconnection with the lower horizontal side frame tubular portion 20. More specifically, the fitting 120 defines a side frame receiving passage 122 extending longitudinally therefore for rotatably receiving the tubular side frame portion. To maintain the horizontal side frame portion and the folding mechanism in proper alignment, the fitting defines a groove 124 extending circumferentially. A projection 126, such as a pop rivet mounted to the side frame, is slidably received in the circumferentially extending groove. The groove is offset in the same direction as the longer free end 106 of the seat support structure such that it is substantially in alignment with the center of the washer 112 of the pivot means. This places the circumferential grooves of the pivotally interconnected seat support structures in alignment across the chair. Both side frames have an aperture bored in the same place the same distance from the front of the frame to receive the mechanical fastener 126. In this manner, the reversibility of the side frames is assured.

An alignment link 130 is pivotally connected at one end with the cross member 104 and has a fitting or connection 132 at its other end which defines an upper generally horizontal extending frame side tube passage 134. The fitting 132 defines a circumferentially extending groove or slot 136 which receives a projection 138 projecting from the upper, horizontally extending tubular side frame portion 16. The circumferentially extending groove or slot 136 is again aligned with the center of the pivot washer 112 such that bores or apertures for the projections 138 are in the same location on both left and right side frames. This enables the side frames to be interchanged without boring additional apertures.

Figure 7:
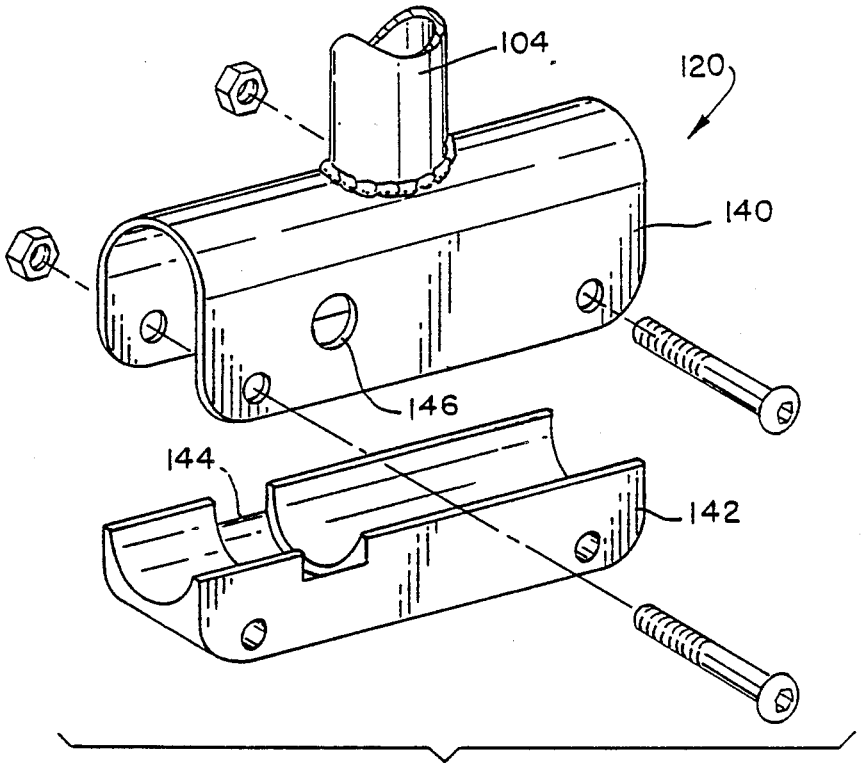
FIG. 7 illustrates an alternate embodiment of the folding mechanism fitting.

With reference to FIG. 7, the fitting 120 may alternately include a U-shaped metal plate 140 which is welding to the lower end of the cross brace member 104. The bottom of the horizontal tubular member receiving passage is defined by an insert 142 which may be of molded plastic or the like. A circumferentially extending groove 144 extends only through the insert 142 and not metal plate 140. When the folding mechanism requires a longer, circumferential groove than is provided by the insert 142, a relief aperture 146 is drilled in the U-shaped plate in alignment with the circumferentially extending groove to receive the projection or a portion thereof at one extreme of motion, e.g. in an opened position.

With reference again to FIG. 1, the seat E includes a lower seat portion 150 of flexible cloth which is anchored by screws 152 or the like to the seat side supports 102. A seat back portion 154 wraps around and is secured to the rear generally vertical side frame tubular members 18 and telescopically received hand grip portions 156.

Figure 8:
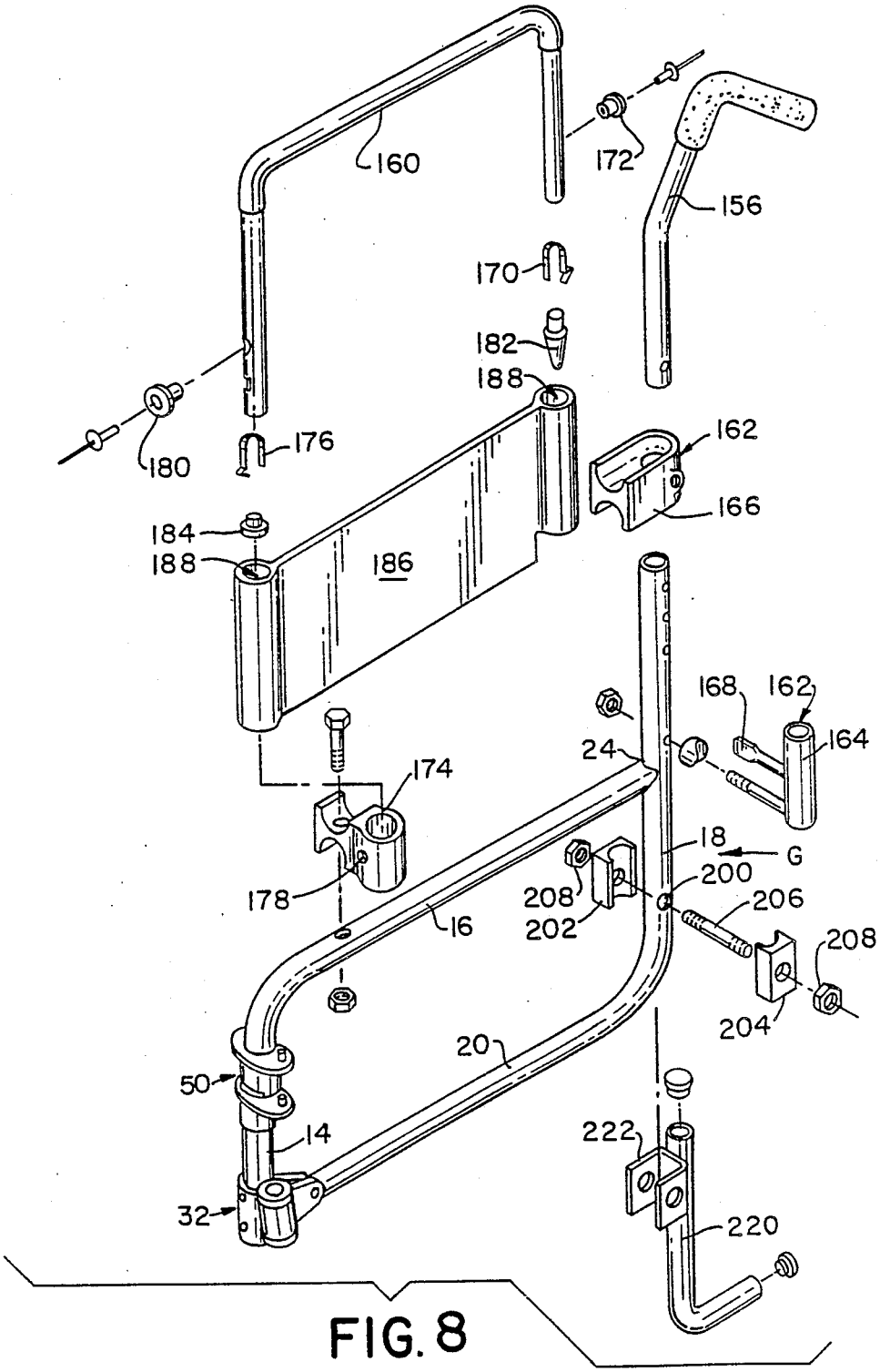
FIG. 8 is an exploded view illustrating the interconnection of a side arm support and shirt guard, a rear wheel mounting assembly, and a curb step mounting assembly; and, FIG. 9 is a side view in partial section illustrating the arm support in its arm supporting position and illustrating a tipped back position in phantom.
Figure 9:
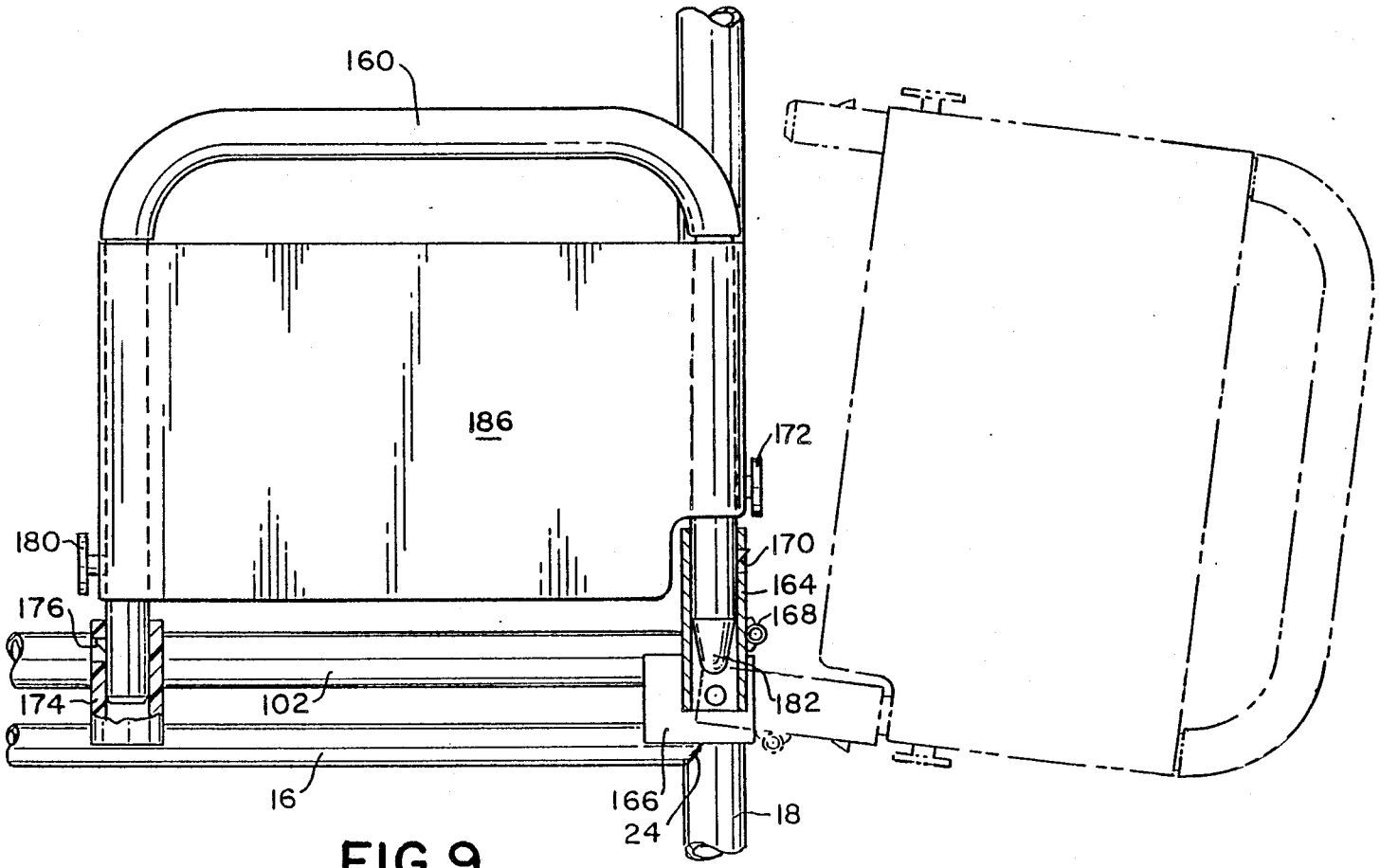

With continuing reference to FIG. 1 and further reference to FIGS. 8 and 9, the arm support structure F includes an arm support member 160 such as a generally U-shaped tube upon which the user's arm may rest. A rearward end of the arm support structure is connected with a first mounting bracket 162 that has a portion 164 which is pivotal relative to the side frames. More specifically, a combined seat side support receiving cradle, weld reinforcing member and first mounting bracket base 166 is connected with the side frame adjacent upper rearward weld 24 to reinforce the weld, support the seat side support 102 when the chair is open, and to have the portion 164 pivotally mounted thereto. A stop 168 limits pivoting movement of the first mounting bracket. A spring detent 170 and release means 172 or other means for releasably securing the arm supporting structure rear end to the first mounting bracket permits the arm support structure to be selectively disconnected therefrom.

A second mounting bracket 174 releasably receives a forward end of the arm supporting structure 160. The second mounting bracket 174 is connected with the upper horizontal side frame tubular portion 16 and defines a seat side support receiving cradle. A second spring detent 176 is spring biased into engagement with an aperture 178 in the second mounting bracket. Upon pressing a release button 180 the spring detent is released from the aperture, allowing the forward end of the arm support structure to be removed from the second bracket. In this manner, the arm support assembly can be removed by pressing both buttons 172 and 180 to release both ends thereof. Alternately, only the front end may be released from the second bracket to allow the arm rest structure to pivot rearward. Preferably, rearward and forward end caps 182, 184, respectively, are configured with a different shape to enable the user to determine which is the front and which is the back of the arm rest structure. A one piece plastic molded shirt guard 186 is molded with passages 186 in either end which are telescopically received over the forward and rearward ends of the generally U-shaped arm supporting structure 160.

With continuing reference to FIGS. 1 and 8, the rear wheel mounting assembly G includes an aperture 200 drilled directly through the rearward vertical tubular portion 18. Because the side frame tubing in the preferred embodiment is relatively light weight, bolting a rear wheel directly in the side frame may cause fatigue and failure. To reinforce the rear frame portion without welding, a pair of reinforcing members 202 and 204 are clamped to either side of the tubing by a threaded tubular member 206 and associated nuts 208. The tubular member 206 extends through the mounting members and the generally vertical rearward tubular side frame portion 18. By clamping the reinforcing members adjacent the side frame aperture, significant additional strength is imparted thereto. An axle mounting shaft or bolt 210 extends into the threaded tubular member 206 to provide an axle for mounting a rear wheel 212 thereon.

A curb step member 220 includes a generally U-shaped mounting bracket 222 which fits securely around the reinforcing members 202, 204. By clamping the U-shaped mounting member 222 to the reinforcing members, additional strength is achieved.

The invention has been described with particular reference to the preferred embodiments. Obviously, alterations and modifications will occur to others of ordinary skill in the art upon reading and understanding the preceding detailed description. It is intended that the invention be construed as including all such alterations and modifications insofar as they come within the scope of the appended claims or the equivalents thereof.

Having thus described a preferred embodiment, the invention is now claimed to be:

1. A wheelchair comprising:

(a) a pair of side frames, each side frame having a generally vertical forward tubular portion having a lower end and an upper end;

(b) a pair of footrest assemblies, each mounted adjacent one of the forward tubular portion upper ends;

(c) a pair of reinforcing tubes each slidably received in one of the forward tubular portions, each reinforcing tube extending from the forward tubular portion lower end toward the upper end at least to a point contiguous to the footrest assembly to distribute loads applied by the footrest assemblies;

(d) a pair of front wheel assemblies, each front wheel assembly including a mounting bracket for receiving one of the forward tubular portions;

(e) a plurality of mechanical fasteners extending through the wheel assembly mounting brackets, the forward tubular portions, and the reinforcing tubes to mount each front wheel assembly to one of the side frames; and, (f) a pair of rearwheels operatively connected to the side frames.

2. The wheelchair as set forth in claim 1 further including a pair of front leg rest mounting brackets which selectively mount a movable, swing away leg rest thereon, each leg rest mounting bracket being attached to one of the side frame generally vertical forward tubular portions and its slidably received reinforcing tube with mechanical fasteners.

3. The wheelchair as set forth in claim 1 further including:

an arm rest assembly which is removably received in forward and rearward arm support structure mounting brackets operatively connected with the side frame, such that the arm support member is removable therefrom; and, a pivot means operatively associated with one of the arm support mounting brackets for permitting the arm support member to pivot relative to the side frames when one end is released from the other mounting bracket.

4. The wheelchair as set forth in claim 1 further including a folding means for interconnecting the pair of side frames for selectively moving the side frames together to a compact configuration to facilitate storage and handling and for selectively moving the side frames apart to an unfolded configuration which readily receives a user seated therebetween.

5. A folding wheelchair comprising:

a pair of side frames, each side frame having a generally vertical forward tubular portion of fixed length;

a folding means for enabling the side frames to be selectively brought together to a folded position and moved apart to an operating position;

a pair of elongated reinforcing means each fixedly received within one of the forward tubular portions and extending between upper and lower portions thereof;

a pair of footrests;

a footrest mounting means for rotatably mounting each footrest to one of the forward tubular portion upper portions for rotation between a forward position for supporting an operator's feet and a side position to facilitate access into and out of the chair;

a pair of locking means for selectively locking the footrests in the forward position and selectively releasing the footrests to be rotated to the side position;

a first plurality of mechanical fasteners for mounting the locking means to the forward tubular portion upper portions, the first plurality of mechanical fasteners each extending through one of the forward tubular portions, one of the reinforcing means, and one of a pair of footrest brackets on which the pair of locking means are supported;

a pair of front wheel assemblies, each front wheel assembly including a front wheel assembly mounting bracket which is mounted adjacent one of the forward tubular portions;

a second plurality of mechanical fasteners extending through the front wheel assembly mounting brackets, the forward tubular portions and the reinforcing members to mount each front wheel assembly to one of the side frames and to lock the front wheel assembly, the forward tubular portion, and the reinforcing member all against relative movement; and, a pair of rear wheels operatively connected with the side frames.

6. The wheelchair as set forth in claim 5 wherein the folding means includes cross members each having an upper and a lower end, each side frame has a lower horizontal frame portion which is rotatably connected with the cross member lower ends and further including a cloth seat extending between a pair of seat supporting members which are connected with cross member upper ends.

7. The wheelchair as set forth in claim 5 wherein the vertical forward tubular portions are constructed of aluminum, which tends to deform or fail under loads imposed by the footrest and the front wheel assemblies and wherein the reinforcing member carriers and distributes the load over a larger portion of the vertical forward tubular portions.

8. A light weight wheelchair comprising:

a pair of aluminum side frames, each side frame having a generally vertical forward tubular portion;

a pair of elongated reinforcing members, each frictionally received in one of the forward tubular portions for distributing loads and forces;

a pair of front footrest assemblies, each footrest assembly including a footrest assembly bracket which is positioned at least partially circumscribing one of the vertical forward tubular portions;

a first plurality of mechanical fasteners for mounting the footrest assembly brackets to the vertical forward tubular portions, each of the first plurality of mechanical fasteners extending through one of the forward tubular portions and one of the reinforcing members such that loads, torques, and impacts received from the footrest assemblies are transmitted to the reinforcing member and distributed;

a pair of front wheel assemblies, each front wheel assembly including a front wheel assembly mounting bracket by which it is mounted to one of the forward tubular portions;

a second plurality of mechanical fasteners which mount the front wheel assembly mounting brackets through the forward tubular portions to at least the reinforcing members such that loads and forces received by the front wheel assemblies during operation of the wheelchair are transmitted to the reinforcing member and distributed along the forward tubular portions; and, a pair of rear wheels operatively connected with the side frames.

9. The light weight wheelchair as set forth in claim 8 wherein each of the front wheel mounting assemblies include a tubular hub portion which is mounted generally parallel to the forward tubular portion by the plurality of mechanical fasteners, a fork assembly which is pivotally received at an upper end thereof in the tubular hub portion and, a forward wheel rotatably mounted on the fork assembly.

10. The light weight wheelchair as set forth in claim 8 wherein the swing away footrest assemblies include a pivot means between the brackets and a forward foot supporting portion such that the forward foot supporting portion selectively swings between a forward position for receiving the operator's legs and to the sides for permitting forward access to the chair.

11. The wheelchair as set forth in claim 8 further including a folding means which interconnects the wheelchair side frame portions for selective folding movement between a folded and an operating position.

12. A wheelchair comprising:

a pair of side frames, each side frame having a generally vertical forward tubular portion and a generally horizontal tubular portion which is welded to the generally vertical forward tubular portion;

a pair of reinforcing tubes each slidably received in one of the forward tubular portions;

a pair of front wheel assemblies, each front wheel assembly including a front wheel assembly mounting bracket, the front wheel assembly mounting bracket being a generally U-shaped bracket which extends around the weld and is connected by mechanical fasteners to the generally horizontally extending tubular portion, the reinforcing tube, and the forward tubular portion, whereby the front wheel assembly mounting bracket reinforces the weld;

a pair of rearwheels operatively connected to the side frames.

* * * * *